United States Patent [19]

Yokoyama

[11] Patent Number: 4,484,541

[45] Date of Patent: Nov. 27, 1984

[54] COOLING SYSTEM FOR AUTOMOTIVE INTERNAL COMBUSTION ENGINE

[75] Inventor: Junichi Yokoyama, Ebina, Japan

[73] Assignee: Nissan Motor Company, Limited, Yokohama, Japan

[21] Appl. No.: 461,918

[22] Filed: Jan. 28, 1983

[30] Foreign Application Priority Data

Feb. 4, 1982 [JP] Japan ..... 57-14419[U]

[51] Int. Cl.[3] ..... F01P 7/16

[52] U.S. Cl. ..... 123/41.1

[58] Field of Search ..... 123/41.02, 41.08, 41.09, 123/41.1, 41.13, 41.44

[56] References Cited

U.S. PATENT DOCUMENTS

| | | | |
|---|---|---|---|
| Re. 16,437 | 10/1926 | Rayfield | 123/41.1 |
| 1,418,397 | 6/1922 | Rayfield | 123/41.1 |
| 1,925,352 | 9/1933 | Twombly | 123/41.1 |

*Primary Examiner*—William A. Cuchlinski, Jr.

[57] ABSTRACT

A cooling system for a liquid cooled automotive internal combustion engine comprises a first device responsive to the temperature of engine coolant flowing through a first section of a coolant passage leading to a radiator. Additionally, a second device is provided to be operative in response to the first device to control the flow of the coolant flowing through a second section of the coolant passage which second section is located downstream of the first section and upstream of a coolant pump. The second device is constructed and arranged to block the coolant passage second section at one of a low engine load operating range and a no engine load operating range when the coolant temperature is over a first predetermined level and not higher than a second predetermined level which is higher than the first predetermined level, while to allow the coolant flow through the coolant passage second section at all engine operating ranges when the coolant temperature is over the second predetermined level. Accordingly, fuel economy and hydrocarbon exhaust emission are effectively improved.

9 Claims, 4 Drawing Figures

COOLING SYSTEM FOR AUTOMOTIVE INTERNAL COMBUSTION ENGINE

BACKGROUND OF THE INVENTION

1. Field of the Invention

This invention relates to an improvement in a cooling system for an automotive internal combustion engine, and more particularly to a cooling system by which exhaust emission and fuel economy are improved.

2. Description of the Prior Art

Most automotive internal combustion engines, in general, employ a cooling system in which liquid engine coolant (cooling water) is forced to circulate through the engine by means of a coolant pump in order to cool the engine. The engine coolant after circulating the engine is introduced into a radiator which dissipates the heat which the coolant has absorbed from the engine. Additionally, a thermostat is provided in a coolant passage upstream of a radiator inlet to regulate the amount of the coolant flowing to the radiator in response to the temperature of the coolant, thereby controlling the coolant temperature at an optimum range. However, with such a cooling system, the cooling capacity due to the thermostat is set to be suitable for a high engine speed and load operating range, and therefore the thus controlled coolant temperature becomes unsuitable at a low load engine operating range or a no load engine operating range including idling. This inevitably deteriorates fuel economy and hydrocarbon exhaust emission.

SUMMARY OF THE INVENTION

A cooling system for a liquid cooled automotive internal combustion engine, of the present invention comprises a first device responsive to the temperature of engine coolant flowing through a first section of an coolant passage leading to a radiator. Additionally, a second device is provided to be operative in response to the first device to control the flow of the coolant flowing through a second section of the coolant passage which second section is located upstream of the first section. The second device is constructed and arranged to block the coolant passage second section at a low engine load operating range and a no engine load operating range when the coolant temperature is over a first predetermined level and not higher than a second predetermined level which is higher than the first predetermined level, and to allow the coolant flow through the second section at all engine operating ranges when the coolant temperature is over the second predetermined level. Accordingly, the amount of coolant to be supplied to the radiator can be regulated in response not only coolant temperature but also to engine load condition. This enables coolant temperature control at a relatively high temperature range during the low engine load and no engine load operations, thereby greatly improving fuel economy and hydrocarbon exhaust emission.

BRIEF DESCRIPTION OF THE DRAWINGS

The features and advantages of the cooling system according to the present invention will be more clearly appreciated from the following description taken in conjunction with the accompanying drawings in which like reference numerals designate corresponding parts and elements, and in which.

DETAILED DESCRIPTION OF THE INVENTION

Figure 1:
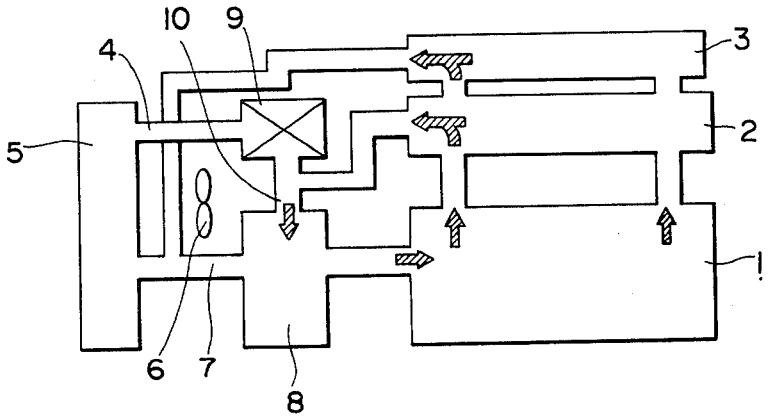
FIG. 1 PRIOR ART
FIG. 1 is a diagrammatic illustration of a conventional cooling system of an automotive internal combustion engine.

To facilitate understanding the present invention, a brief reference will be made to a conventional cooling system of an automotive internal combustion engine, depicted in FIG. 1. In such a conventional cooling system, engine coolant admitted to a coolant jacket 1 formed in a cylinder block is supplied to coolant jackets 2 and 3 formed respectively in a cylinder head and an intake air conduit. The engine coolant leaving the water jackets 2 and 3 are introduced to a radiator 5 through a radiator inlet passage 4 or coolant passage which is connected to and disposed upstream of the radiator 5. The coolant is cooled during its passage through the radiator by air flow due to a cooling fan 6 located at the rear side of the radiator 5. The thus cooled coolant is supplied to a coolant pump 8 through a radiator outlet passage 7 or coolant passage which is connected to and disposed downstream of the radiator 5. The coolant supplied to the coolant pump 8 is again circulated to the coolant jackets 1, 2 and 3 which are respectively formed in the cylinder block, cylinder head and intake air conduit, thus accomplishing cooling of the engine. Additionally, a thermostat 9 is disposed in the radiator inlet passage 4 to regulate the amount of the coolant flowing into the radiator, thereby controlling the temperature of the coolant at an appropriate level such as 80°–90° C. The reference numeral 10 denotes a bypass passage which connects the coolant pump 8 with the radiator inlet passage 4 upstream of the thermostat 9 in order to feed the coolant upstream of the thermostat 9 into the coolant pump 8.

Figure 2:
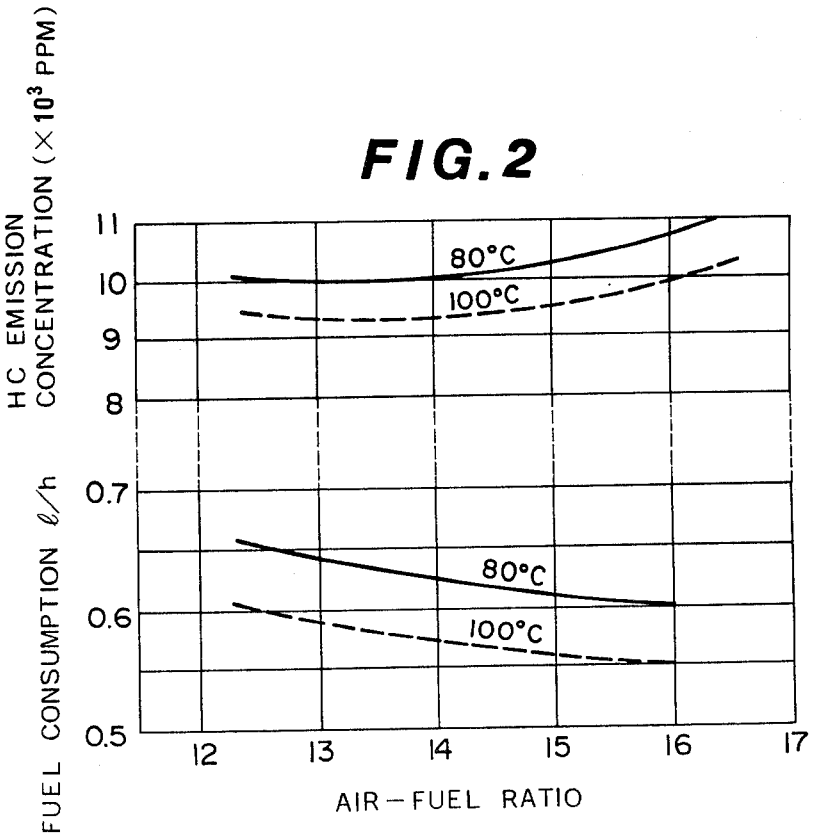
FIG. 2 is a graphical representation showing the effect of engine coolant temperature on hydrocarbon exhaust emission and fuel consumption.

However, in the thus arranged conventional cooling system, since the cooling capacity due to the thermostat 9 is set to be suitable for a high speed and load engine operating range, the coolant temperature becomes unsuitable for a low load engine operating range or a no load engine operating range including idling. In other words, under such low or no load engine operation, the coolant temperature becomes excessively low from the view points of obtaining low hydrocarbon exhaust emission and improved fuel economy. This will be appreciated from FIG. 2 in which the hydrocarbon exhaust emission and the fuel consumption at a low coolant temperature (80° C.) condition deteriorate as compared with those at a high coolant temperature (100° C.) condition. This is because the sliding friction of a piston against a cylinder wall increases and combustion within an engine combustion chamber deteriorates under such a low coolant temperature condition.

Figure 3:
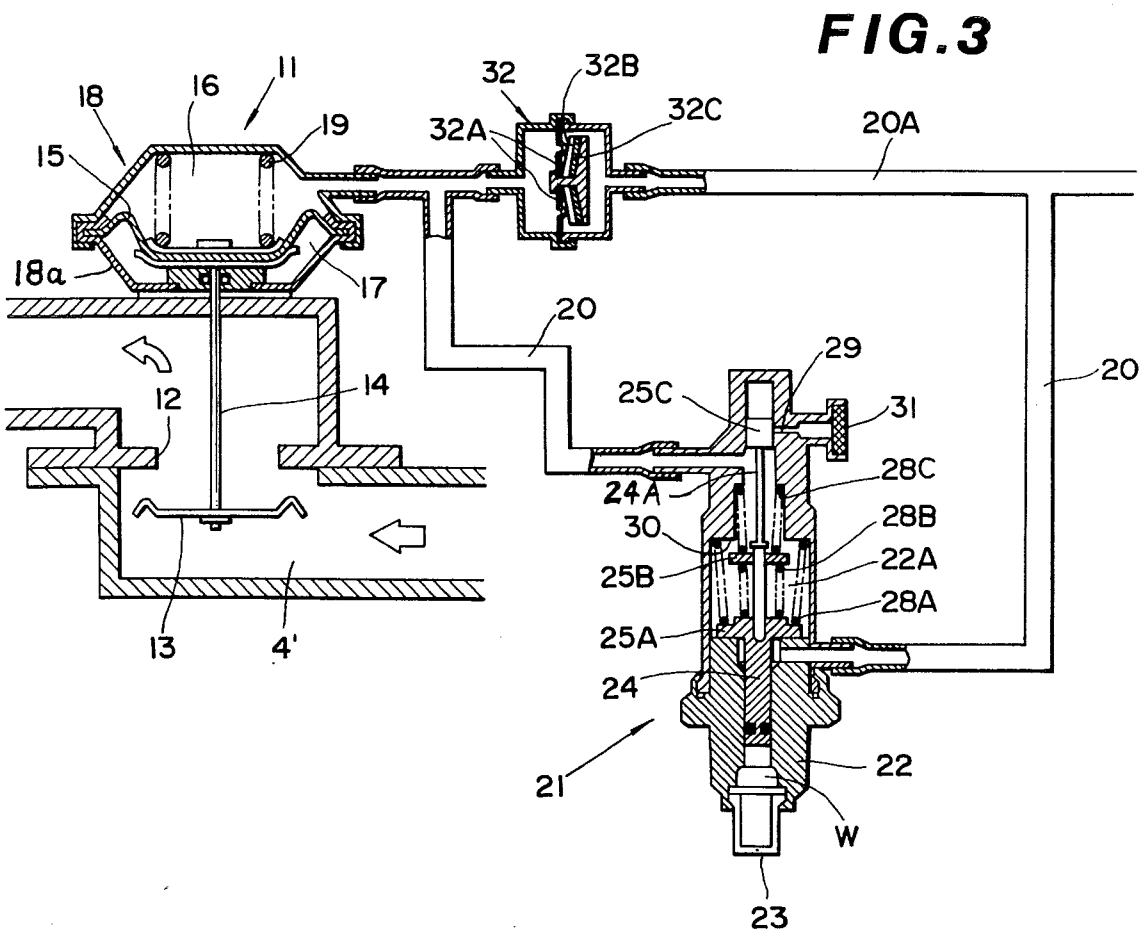
FIG. 3 is a sectional view of an essential part of an embodiment of a cooling system for an automotive internal combustion engine, in accordance with the present invention.

In view of the above, reference is now made to FIG. 3, wherein an essential part of a preferred embodiment of a cooling system according to the present invention is illustrated. The cooling system is similar to the conventional one shown in FIG. 1 except the essential part shown in FIG. 3 and therefore the explanation of the other parts same as in FIG. 1 will be omitted. As such, the explanation of the present invention will be made also in connection with FIG. 1.

The cooling system, in this embodiment, is for an automotive internal combustion engine and comprises a coolant flow control valve 11 which is arranged to establish or block coolant flow through a radiator inlet passage 4' in response to intake manifold vacuum of the engine, thereby regulating coolant flow through a radiator in accordance with engine operating conditions particularly to engine load conditions. The radiator is not shown in FIG. 3 but corresponds to the radiator 5 in FIG. 1. The radiator inlet passage 4' corresponds to the same passage 4 in FIG. 1. Accordingly, the control valve 11 is used in place of the thermostat 9 of the conventional cooling system of FIG. 1.

The flow control valve 11 includes a valve member 13 which is movable upward or downward in the drawing to close or open a valve opening 12 formed in the radiator inlet passage 4', so that coolant flow through the radiator inlet passage 4' is blocked when the valve member 13 closes the opening 12 while is established when the valve member 13 opens the valve opening 12. The valve member 13 is connected through a rod 14 with a diaphragm 15 which forms part of a vacuum actuator 18. The diaphragm 15 divides the interior of a casing **18*a* into a vacuum chamber 16 located on the upper side in the drawing, and an atmospheric chamber 17 located on the lower side in the drawing. The vacuum chamber 16 is communicable through a vacuum passage 20 with an intake air passageway (not shown) downstream of a throttle valve (not shown) so as to be supplied with intake manifold vacuum. The atmospheric chamber 17 is communicated with atmospheric air. A spring 19 is disposed within the vacuum chamber 16 to force the diaphragm 15 downward in the drawing so as to urge the valve member 13** downward in the drawing.

Accordingly, at a low load (or no load) engine operating range where the throttle valve closes to the nearly fully closed position to increase intake manifold vacuum, the vacuum introduced to the vacuum chamber 16 of the vacuum actuator 18 becomes high and consequently the diaphragm 15 yields upward in the drawing. This causes the valve member 13 to move upward against the bias of the spring 19 in the drawing, thereby closing the valve opening 12. On the contrary, at a high load engine operating range where the throttle valve relatively largely opens to decrease the intake manifold vacuum, the vacuum within the vacuum chamber 16 is lowered so that the diaphragm 15 yields downward by the spring 19. Consequently, the valve member moves downward to cause the valve opening 12 to open.

Additionally, a thermally responsive vacuum control valve 21 is provided to modify or control the intake manifold vacuum to be introduced to the vacuum chamber 16, in response to the temperature of the engine coolant upstream of the flow control valve 11, for example, the temperature of the coolant in the radiator inlet passage 4' upstream of the flow control valve 11. The vacuum control valve 21 includes a thermally responsive section 23 which is located at the bottom part of the vacuum control valve 21 and in contact with the coolant. The thermally responsive section 23 contains a wax W which expands or contracts when the coolant temperature is over or below a predetermined level (for example, 80° C.). The vacuum control valve 21 further includes first, second and third valve members 25A, 25B and 25C which are operatively connected through a rod 24 with the wax W of the thermally responsive section 23 and move upward or downward within a valve chamber 22A of a valve body 22 in the drawing. The first valve member 25A is integral with the rod 24 and normally urged downward in the drawing to be seated on a valve seat (no numeral) by a spring 28A. The first valve member 25A is so arranged as to establish or block the communication between the upstream and downstream sides of the vacuum passage 20 relative to the vacuum control valve 21. The second valve member 25B is annular and slidably fits around a connecting rod **24*a* connecting the rod 24 with the third valve member 25C. The second valve member 25B is located between a lower spring 28B and an upper spring 28C to be suspended in the valve chamber 22A. The lower spring 28B is interposed between the first valve member 25A and the second valve member 25B. The upper spring 28C is disposed to urge the second valve member 25B downward in the drawing. The springs 28B and 28C are lower in spring constant than the first spring 28A. Accordingly, the second valve member 25B is so arranged as to block communication between the upstream and downstream sides of the vaccum passage 20 relative to the vacuum control valve 21 when the second valve member 25B is seated on a valve seat 30 formed within the valve chamber 22A. The third valve member 25C is, as stated above, fixedly connected through the connecting rod 24*a* with the first valve member 25A to be moved with the first valve member 25A as a single piece. The third valve 25C is arranged to close or open an atmospheric air inlet passage 29 which is communicated through an air filter 31** with atmospheric air.

Hence, when the temperature of the coolant around the thermally responsive section 23 of the vacuum control valve 21 is not higher than a first predetermined level (for example, 80° C.), the wax W of the thermally responsive section 23 does not expand, so that the first, second and third valve members 25A, 25B and 25C are respectively located at positions shown in FIG. 3 in which the first valve member 25A closes the vacuum passage 20. This blocks the communication between the upstream and downstream sides of the vacuum passage 20 relative to the vacuum control valve 21. At this time, the third valve member 25C also closes the atmospheric air inlet passage 29.

When the coolant temperature rises over the first predetermined level, the first valve member 25A moves upward against the bias of the spring 28A in accordance with the expansion of the wax W, thereby opening the vacuum passage 20 to establish the communication between the upstream and downstream sides of the vacuum passage 20 relative to the vacuum control valve 21. At this time, the second valve member 25B remains maintained nearly at the position shown in FIG. 3, and the third valve member 25C continues to close the atmospheric air inlet passage 29 though it moves upward in the drawing.

When the coolant temperature further rises over a second predetermined level (for example, 100° C.), the first valve member further moves upward along with a further expansion of the wax W, so that the biasing force of the spring 28B begins to act on the second valve member 25B. Thus, the second valve member 25B is seated on the valve seat 30 so as to block the vacuum passage 20. Additionally, this upward movement of the rod 24 causes the third valve member 25C to further move upward so as to open the atmospheric air inlet passage 29, thereby allowing the vacuum passage 20 to become communicated with atmospheric air.

Additionally, a bypass vacuum passage 20A is provided in a manner to bypass the vacuum control valve 21. Accordingly, the bypass vacuum passage 20A connects the upstream and downstream sides of the vacuum passage 20 relative to the vacuum control valve 21. The bypass passage 20A is provided with a check valve 32 which is arranged to open to establish communication between the upstream and downstream sides of the vacuum passage 20 only when the intake manifold vacuum exceeds a predetermined high level encountered at a low engine load operating range (including deceleration) or a no engine load operating range such as idling. The check valve 32 is of the known type and includes a partition wall (no numeral) provided with through-holes 32A which are closable with a resilient valve member 32B. The resilient valve member 32B is normally urged to close the through-holes 32A. The reference numeral 32C denotes a plate spring.

The manner of operation of the cooling system shown in FIG. 3 will be discussed hereinafter.

When the coolant temperature is not higher than the first predetermined level, the vacuum passage 20 is blocked. Consequently, only under a high intake manifold vacuum condition such as at a low load engine operating range (including deceleration) or a no load engine operating range (for example, idling), the check valve 32 opens to introduce the intake manifold vacuum to the vacuum passage 20 downstream of the vacuum control valve 21. As a result, the thus introduced higher vacuum is supplied to the vacuum chamber 16 of the vacuum actuator 18, so that the coolant flow control valve 11 is operated to always block the radiator inlet passage 4'. Thus, the radiator is prevented from being supplied with the coolant, and therefore the coolant is again circulated, without being cooled, to a cylinder block coolant passage (corresponding to numeral 1 shown in FIG. 1) through a bypass passage (corresponding to numeral 10 shown in FIG. 1). As a result, the temperature of the coolant quickly and smoothly rises.

When the thus risen coolant temperature exceeds the first predetermined level, the thermally responsive vacuum control valve causes the vacuum passage 20 to open to establish vacuum supply through the vacuum passage 20. Accordingly, at the low engine load operation or the no engine load operating range in which intake manifold vacuum is higher, the vacuum to be supplied to the vacuum chamber 16 of the vacuum actuator 18 increases, so that the coolant flow control valve 11 blocks the radiator inlet passage 4'. As a result, the coolant temperature relatively rises at such an engine operating range and therefore fuel consumption and hydrocarbon emission are greatly improved.

At a high load engine operating range in which the intake manifold vacuum is lower, the vacuum to be supplied to the vacuum actuator vacuum chamber 16 is lowered, so that the valve member 13 of the coolant flow control valve 11 is operated to open the radiator inlet passage 4'. Then, the coolant flows into the radiator to be cooled. As a result, at such an engine operating range, the feedback control of the coolant temperature is carried out relative to the first predetermined level which is optimum at such an engine operating range.

Furthermore, at the above-mentioned low load engine operating range or the like, when the risen coolant temperature exceeds the second predetermined level, the thermally responsive vacuum control valve 21 causes the vacuum passage 20 to be supplied with atmospheric air. As a result, the valve member 13 of the coolant flow control valve 11 is operated to open the radiator inlet passage 4' regardless of engine operating condition or intake manifold condition. Consequently, the coolant flows into the radiator to be cooled, thereby preventing the coolant temperature from an excessive rise at the low load engine operating range or the like. In other words, the feedback control of the coolant temperature is carried out relative to the second predetermined level during such an engine operation.

Figure 4:
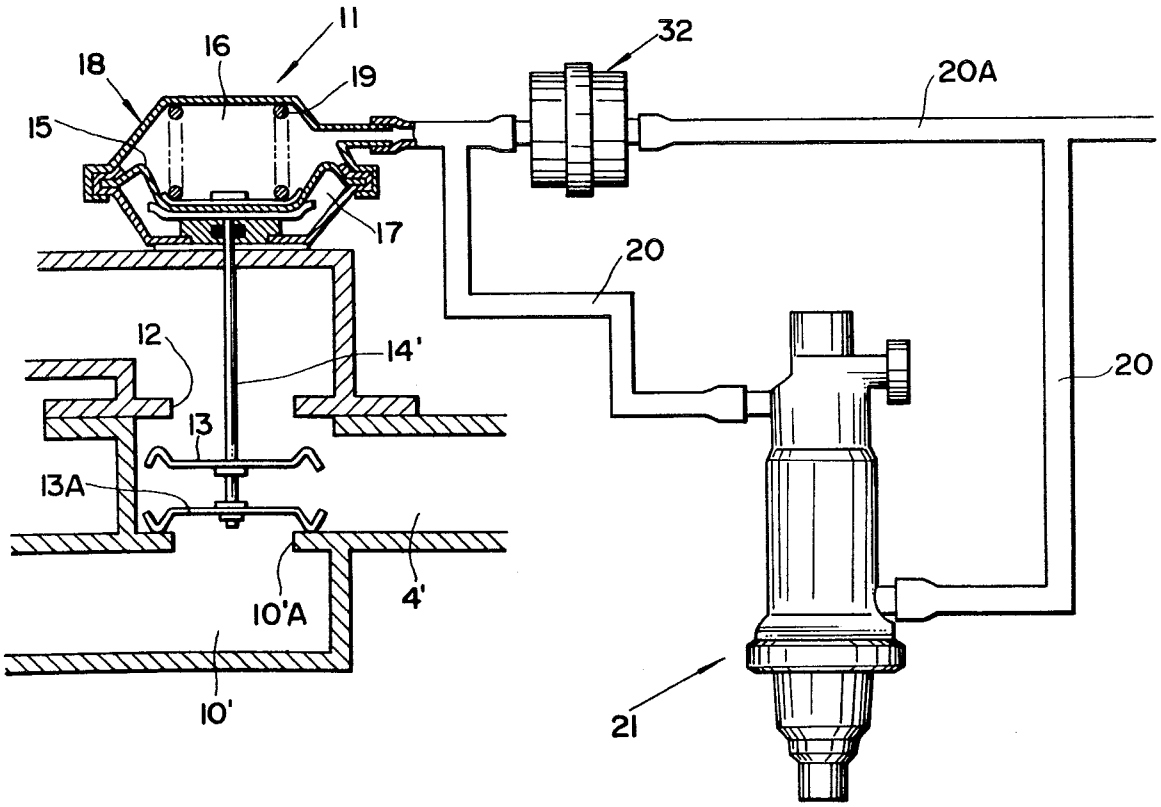
FIG. 4 is a sectional view similar to FIG. 3, but showing another embodiment of the cooling system according to the present invention.

In addition, at such a low engine load operating range, the check valve 32 is opened to supply therethrough atmospheric air into an intake system (not shown) of the engine which atmospheric air is introduced through the atmospheric air inlet 29 to the vacuum passage 20. This prevents air-fuel mixture from being enriched FIG. 4 shows another embodiment of the cooling system according to the present invention. In this embodiment, the bypass passage 10' (corresponding to numeral 10 shown in FIG. 1) is opened at its upstream end to the radiator inlet passage 4' immediately under the valve member 13 of the coolant flow control valve 11, forming an opening 10'A through which the bypass passage 10' is in direct communication with the radiator inlet passage 4'. Additionally, an additional valve member 13A is secured to the rod 14' and located under the valve member 13 so as to move with the valve member 13 as a single piece. The additional valve member 13A is so arranged as to fully close the opening 10'A when the valve member 13 opens the opening 12. With this arrangement, when the coolant flows into the radiator to be cooled, all the amount of coolant after circulation through the engine is supplied through the radiator inlet passage 4' to the radiator, thereby shortening the cooling time.

As will be appreciated from the above, according to the present invention, the coolant flow control valve operative in response to the operation of the thermally responsive vacuum control valve is used in place of the thermostat in the conventional cooling system, which thermostat controls the amount of coolant to be supplied to the radiator only in response to the temperature of the coolant. Therefore, according to the present invention, the amount of coolant to be supplied to the radiator is controlled in response to engine load condition and coolant temperature condition. This enables coolant temperature control at a relatively high level range particularly during the low load engine operating range or the no load engine operating range, such as idling, as compared with other engine operating ranges, thereby greatly improving fuel economy and reducing hydrocarbon exhaust emission.

What is claimed is:

1. A cooling system for a liquid cooled automotive internal combustion engine equipped with a radiator, comprising:

a valve member movably disposed in a coolant passage leading to the radiator and capable of restricting flow of coolant to the radiator;

a vacuum actuator for controlling operation of said valve member in response to intake vacuum supplied thereto, said vacuum actuator being constructed and arranged to control the operation of said valve member so that the degree of restricting the coolant flow to the radiator increases as said intake vacuum increases; and a thermally responsive vacuum control valve fluidly connected to said vacuum actuator, for controlling supply of the intake vacuum to said vacuum actuator in response to the temperature of the coolant in the coolant passage upstream of said valve member, said control valve being constructed and arranged so as to supply the intake vacuum to said vacuum actuator when the coolant temperature is between a first predetermined level and a second predetermined level higher than said first predetermined level, said control valve including means for blocking the supply of the intake vacuum to said vacuum actuator when the coolant temperature is above the second predetermined level.

2. A cooling system as claimed in claim 1, wherein said vacuum actuator has a vacuum chamber communicable with an intake air passageway downstream of a thottle valve and communicable with atmospheric air, said vacuum actuator being arranged to cause said valve member to block said coolant passage when said vacuum chamber is subjected to an intake vacuum higher than a predetermined level, and to establish coolant flow through said coolant passage when said vacuum chamber is communicated with the atmospheric air; said vacuum control valve being operatively disposed between the vacuum chamber and said intake air passageway.

3. A cooling system as claimed in claim 2, wherein said vacuum control valve includes a thermally expandable member disposed to be subjected to the heat of the coolant.

4. A cooling system as claimed in claim 3, wherein said vacuum control valve is disposed in a vacuum passage connecting the vacuum chamber with said intake air passageway, and includes a first valve member operatively connected to said thermally expandable member and arranged to block said vacuum passage when the coolant temperature is not higher than the first predetermined level while to open said vacuum chamber when the coolant temperature is over the first predetermined level; and a second valve member operatively connected to said first valve member and arranged to open said vacuum passage when the coolant temperature is over the first predetermined level and not higher than the second predetermined level while to block the vacuum passage when the coolant temperature is over the second predetermined level; and a third valve member connected to said first valve member and arranged to close an atmospheric air inlet passage communicable with said vacuum passage when the coolant temperature is not higher than the second predetermined level while to cause the atmospheric air inlet passage to be communicated with said vacuum passage when the coolant temperature is above the second predetermined level.

5. A cooling system as claimed in claim 4, wherein said vacuum control valve includes a casing having a vacuum inlet communicated with said intake air passageway and a vacuum outlet communicated with said vacuum actuator vacuum chamber, said casing defining therein a valve chamber communicable with said vacuum inlet and outlet, a first spring biasing said first valve member so as to block the communication between said valve chamber and said vacuum inlet, a second spring interposed between said first and second valve members, a third spring biasing said second valve member in the direction of said second valve member, said second valve member slidably fitting around a connecting rod connecting said third valve member to said first valve member, said second valve member being seatable on a valve seat to block the communication between said vacuum inlet and outlet, said third valve member permitting said atmospheric air inlet passage to communicate with said valve chamber.

6. A cooling system as claimed in claim 1, wherein said vacuum actuator is arranged to allow coolant flow through said coolant passage when the coolant temperature is not higher than the first predetermined level.

7. A cooling system as claimed in claim 6, comprising means for blocking said coolant passage when the coolant temperature is not higher than the first predetermined level.

8. A cooling system as claimed in claim 1, wherein said vacuum control valve is arranged to block communication between the vacuum actuator vacuum chamber and said intake air passageway when the coolant temperature is not higher than the first predetermined level.

9. A cooling system as claimed in claim 1, comprising a coolant pump, a bypass passage connecting the coolant passage with said coolant pump, and means for blocking said bypass passage.

* * * * *